US011096455B2

(12) United States Patent
Douglas

(10) Patent No.: US 11,096,455 B2
(45) Date of Patent: Aug. 24, 2021

(54) WEARABLE BAND AND WEARABLE DISPLAY APPARATUS

(71) Applicant: SNAPWATCH LIMITED, Hampshire (GB)

(72) Inventor: Vincent Douglas, Andover (GB)

(73) Assignee: Snap Watch Limited, Hampshire (GB)

( * ) Notice: Subject to any disclaimer, the term of this patent is extended or adjusted under 35 U.S.C. 154(b) by 0 days.

(21) Appl. No.: 16/097,038

(22) PCT Filed: Apr. 26, 2017

(86) PCT No.: PCT/GB2017/051164
§ 371 (c)(1),
(2) Date: Oct. 26, 2018

(87) PCT Pub. No.: WO2017/187170
PCT Pub. Date: Nov. 2, 2017

(65) Prior Publication Data

US 2019/0150575 A1 May 23, 2019

(30) Foreign Application Priority Data

Apr. 28, 2016 (GB) ..... 1607423

(51) Int. Cl.
*A44C 5/00* (2006.01)
*A45F 5/02* (2006.01)
*A45F 5/00* (2006.01)

(52) U.S. Cl.
CPC ..... *A44C 5/0069* (2013.01); *A44C 5/0007* (2013.01); *A44C 5/0053* (2013.01)

(58) Field of Classification Search
CPC ... A45F 5/022; A45F 2005/008; A44C 5/0053
(Continued)

(56) References Cited

U.S. PATENT DOCUMENTS 2,448,943 A * 9/1948 Wolff ..... A44C 5/14 224/168
3,410,023 A * 11/1968 Anello ..... A63H 33/00 446/353

(Continued)

FOREIGN PATENT DOCUMENTS

CN 202436283 9/2012
FR 2670092 A3 * 6/1992 ..... A47G 21/16

(Continued)

OTHER PUBLICATIONS

International Search Report, International Application No. PCT/GB2017/051164, dated Jul. 28, 2017.

*Primary Examiner* — Nathan J Newhouse
*Assistant Examiner* — Lester L Vanterpool
(74) *Attorney, Agent, or Firm* — Morse, Barnes-Brown & Pendleton, P.C.; Sean D. Detweiler, Esq.

(57) ABSTRACT

A wearable band of a size and length suitable to be positioned around a limb, or other body part, of a user, said band comprising a flexible bistable strip movable between a first state, in which it is substantially axially straight, and a second, ring-like state, and having a yield point, said band being configured such that generally radial application of pressure exceeding said yield point to an end of said hand causes it to move, under its own tension, from said first state to said second state, wherein a portion of the length of said bistable strip at a free end thereof has a progressively reducing width and/or thickness such that the tensile force in said portion, when said band is in said first configuration, gradually lessens along said portion toward said free end.

11 Claims, 3 Drawing Sheets

Figure 1:
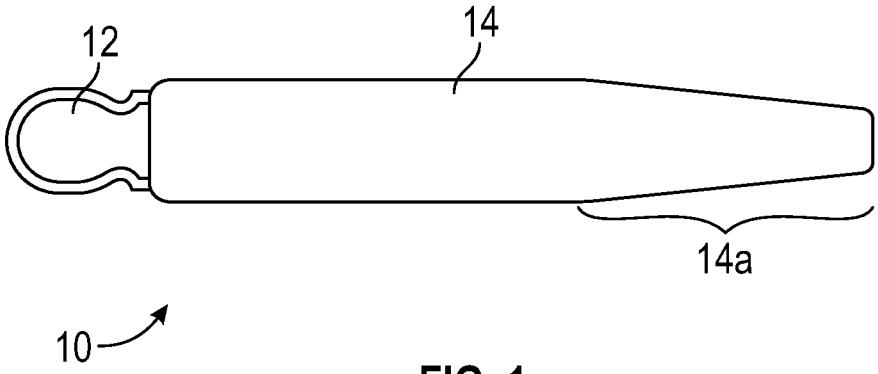

(58) Field of Classification Search
USPC ..... 224/164, 219, 218
See application file for complete search history.

(56) References Cited

U.S. PATENT DOCUMENTS 3,627,181 A * 12/1971 Bianchi ..... A41F 9/002 224/150
4,130,987 A * 12/1978 Schickedanz ..... G04B 19/08 368/282
4,724,548 A * 2/1988 London ..... A41F 9/002 2/170
5,821,688 A * 10/1998 Shanks ..... H01L 51/5012 313/498
5,857,217 A * 1/1999 Hsueh ..... A44C 5/0007 2/170
5,931,764 A * 8/1999 Freeman ..... G06K 19/07703 482/4
5,971,612 A * 10/1999 McAuslan ..... A45C 11/16 383/39
6,216,490 B1 * 4/2001 Radley-Smith ..... G04G 9/08 63/3
6,425,494 B1 * 7/2002 Woods, II ..... B65D 81/3879 215/12.1
7,383,588 B2 * 6/2008 Victor ..... A41D 20/00 2/16
8,162,383 B2 * 4/2012 Curtis ..... B60R 13/043 296/180.4
8,482,909 B2 * 7/2013 Douglas ..... G09F 3/005 361/679.03
9,629,441 B2 * 4/2017 Schaller ..... B65D 75/52
9,844,252 B2 * 12/2017 Kraszewski ..... A45D 2/127
9,944,111 B2 * 4/2018 Elmore ..... B43K 7/12
2010/0258601 A1 * 10/2010 Thrope ..... A45C 1/00 224/267
2011/0185611 A1 * 8/2011 Adams ..... H04Q 5/22 40/633
2012/0228318 A1 * 9/2012 Martin ..... A47G 23/0216 220/739
2013/0044215 A1 2/2013 Rothkopf et al.
2013/0213428 A1 * 8/2013 Manno ..... A45D 8/36 132/210
2013/0266360 A1 * 10/2013 Elmore ..... B43K 7/005 401/8
2014/0039932 A1 * 2/2014 Walton, III ..... G16H 10/65 705/3
2014/0063440 A1 3/2014 Butler
2014/0274614 A1 * 9/2014 Newman ..... A63B 21/4035 482/139
2015/0165338 A1 * 6/2015 Choe ..... A63H 33/18 446/46
2015/0182009 A1 7/2015 Whang et al.
2015/0313542 A1 * 11/2015 Goldberg ..... A61B 5/024 600/384
2016/0290624 A1 * 10/2016 Dai ..... F21L 4/02
2016/0349797 A1 * 12/2016 Malhotra ..... G06F 1/1643
2017/0049628 A1 * 2/2017 Stevens ..... A61F 13/00029
2017/0281082 A1 * 10/2017 Khine ..... A61B 5/02055

FOREIGN PATENT DOCUMENTS

FR 2792507 A1 * 10/2000 ..... A44C 5/12
WO WO-0059327 A1 * 10/2000 ..... A44C 5/0015
WO WO 2004/068990 A1 8/2004
WO WO 2014/035680 A2 3/2014

* cited by examiner

WEARABLE BAND AND WEARABLE DISPLAY APPARATUS

RELATED APPLICATIONS

This application is a national stage filing under 35 U.S.C. 371 of International Application No. PCT/GB2017/051164, filed Apr. 26, 2017, which claims priority to Denmark Application No. GB 1607423.9, filed Apr. 28, 2016. The entire teachings of said applications are incorporated by reference herein.

This invention relates generally to a wearable band and, more particularly but not necessarily exclusively, to a wearable snap band for securing a display apparatus to a user's limb.

Wearable displays, such as wristwatches and health monitors, are well known and available in many different formats, to suit personal tastes and disposable income. Such products all tend to have the same basic features, including some form of control unit incorporating the device mechanism, control functions and, in some cases, the display itself, and a strap or bracelet that surrounds the wearer's wrist and a clasp or buckle to secure the whole arrangement to the wearer's wrist.

International Patent Application no. PCT/GB2004/000468 describes another type of wearable display apparatus, in which the display and the strap are integrated together to form a flexible display band. The flexible display band described does not require a latch or other retaining means to secure the device to a user's wrist. Instead, in a described embodiment, a malleable display band is provided, including a layer of flexible stainless steel or the like, that is initially axially straight and, upon application of lateral pressure thereto (that exceeds some predetermined yield point inherent to the band) can be moulded to a desired configuration around a user's wrist.

In a similar vein, but in the context of a novelty jewellery item, a so-called "snap bracelet" is known, which comprises a layered flexible stainless steel bistable spring band which, when straightened out, creates tension within the metal bands. When pressure is applied laterally to the composite band, it springs back into a curve that encircles the user's wrist, creating a snapping sound as the ends of the band meet.

A problem associated with this type of band is the force with which the band springs from the extended state to the curved state. In known snap bands, this force can be quite powerful and the closing movement can be quite sudden, such that bruising or other injury to the user may result. Furthermore, repeated operation of the snap bracelet, with the resultant force and sudden movement, can result in any protective covering provided on the stainless steel layers becoming damaged, thus exposing the metal edges and further increasing the potential for injury to the user. In the context of display apparatus or a computing device, this may be further exacerbated since the band needs to be robust and secure, and this essential robustness and security needs to be achieved by providing a flexible band having a predetermined minimum strength/thickness. Thus, the tension created in the band in its extended state is inevitably relatively high and the resultant force with which the band springs into the curved configuration is correspondingly high. The speed at which the closing movement occurs would also be high and these factors, together, further increase the risk of injury to the user and/or damage to the band. For these reasons, it has previously been thought that this type of snap bracelet or snap band is unsuitable for use in display apparatuses of the types described above.

It is an object of aspects of the present invention to address at least some of these issues and, in accordance with a first aspect of the present invention, there is provided a wearable band of a size and length suitable to be positioned around a limb, or other body part, of a user, said band comprising a flexible bistable strip movable between a first state, in which it is substantially axially straight, and a second, ring-like state, and having a yield point, said band being configured such that generally radial application of pressure exceeding said yield point to an end of said band causes it to move, under its own tension, from said first state to said second state, wherein a portion of the length of said bistable strip at a free end thereof has a progressively reducing width and/or thickness such that the tensile force in said portion, when said band is in said first configuration, gradually lessens along said portion toward said free end.

Thus, a progressively lessening tensile force is created at the end of the band, when it is in the first (extended or "straight") state, which is transformed into a progressively reducing kinetic energy (along that portion toward the end of the band) when the band is moving into the second, coiled state. This has the result of slowing and softening the movement of the band into the curved configuration, thereby alleviating the problems noted above.

In an exemplary embodiment of the invention, the above-mentioned portion of the length of the bistable strip has at least one side edge that is tapered toward said end, thereby progressively reducing the width of the bistable strip along the length of the above-mentioned portion. In one particular exemplary embodiment, both side edges of the above-mentioned portion of the length of the bistable strip are tapered toward said end, thereby progressively reducing the width of the bistable strip along the length of said portion. The angle of taper of the or each side edge may be between 5° and 20° relative to the axial length of the strip. In some exemplary embodiments, the angle of taper may be 5-15° relative to the axial length of the strip, and in some embodiments it may be 5-10° relative to the axial length of the strip. In a specific exemplary embodiment, the angle of taper may be around 6.5° (i.e. between 6 and 7°) relative to the axial length of the strip.

In some exemplary embodiments, the above-mentioned portion of the length of the strip may be at least one eighth, or even at least one sixth of the total length of the strip and, in some exemplary embodiments, the portion may be at least one third of the total length of the strip. It is thought that the portion of the strip is likely to be between 30-50% of the total length of the strip, and in some cases 35-45% of the total length of the strip. In a specific exemplary embodiment, the above-mentioned portion of the strip may comprise around 40% of the total length of the strip.

In an exemplary embodiment of the invention, the bistable strip may comprise an elongate strip of flexible tempered steel, bistable reeled composite (BRC) or graphene, which may be transversely concave. The band may comprise a rubber backing, a strip of thin steel forming said bistable strip and an anti-moisture coating.

In accordance with another aspect of the present invention, there is provided a display apparatus comprising a wearable band substantially as described above and, optionally, a control unit provided on the band.

In accordance with yet another aspect of the present invention, there is provided an electronic device comprising a wearable band substantially as described above.

In an exemplary embodiment of the electronic device, the wearable band may incorporate a layer having thereon one or more electronic components, and the device further comprises a power supply. In its simplest form, said one or more electronic components may comprise light emitting diodes, although in other exemplary embodiments the layer having thereon one or more electronic components may comprise a flexible PCB and/or memory.

The power supply may comprise a flexible battery in the form of a strip and incorporated in said wearable band, and conductively connected to said electronic components.

Controls may be provided on said wearable band, which may comprise touch-sensitive areas on said wearable band. The device may comprise a flexible display incorporated in the wearable band.

In other exemplary embodiments, the device may further comprise a control unit, and a power supply may optionally be provided in said control unit, and a conductive strip incorporated in said wearable band connecting said power supply to said one or more electronic components.

The control unit may include a display and/or one or more controls. Such controls may comprise one or more push buttons, a keypad and/or one or more touch-sensitive areas.

In embodiments where a control unit is provided, the control unit may be provided at one end of the wearable band and said portion of the length of the bistable strip is provided at the axially opposing end of the band.

In an exemplary embodiment, the wearable band may comprise a rubber backing, a strip of thin steel, bistable reeled composite or graphene forming the bistable strip, an electro-luminescent display, a filter layer and an anti-moisture coating.

The electronic device may, for example comprise a computing device including a processor, memory, power supply, controls, a display and a wireless connectivity.

The processor, wireless connectivity module and memory may comprise a flexible PCB incorporated in said wearable band, said power supply may comprise a flexible battery incorporated in said wearable band, and wherein said controls and display may be provided on said wearable band. In this case, therefore, all of the device functionality, display and controls is provided in the wearable band and a control unit is not necessarily required.

In other exemplary embodiment, a control unit may be provided in or on said wearable band, wherein one or more of said processor, memory, wireless connectivity module, display and controls is provided in or on said control unit. Thus, on the one hand, all of the processor, memory, wireless connectivity module, power supply, display and controls may be provided in or on the control unit (in which case, the wearable band may be entirely passive, or it may incorporate simple display elements, such as LEDs, connected by a conductive strip to the power supply in the control unit. In yet other exemplary embodiments, one or more of the processor, memory, power supply wireless communications module, display and controls may be provided in or on the control unit, whilst the other one or more elements are incorporated in the wearable band to form a truly hybrid device.

The electronic device may, for example, comprise a music streaming/playing device including a processor, memory, power supply, wireless connectivity module, display, controls and one or more loudspeakers and/or a headphone jack/wireless headphone connectivity.

In yet another exemplary embodiment, the electronic device may comprise a display device configured to display information on the wearable band. For example, the display device may be configured to be worn on a user's arm or wrist, and include a flexible display layer for displaying information thereon. Such information may be received from the control unit. There are many flexible display technologies that could be suitable for use in aspects of the present invention, including, but not limited to, OLCD (organic Liquid Crystal Display), OLED (organic light emitting diode), PLED (power light emitting diode), EPD (electronic paper display or electrophoretic technology), AMOLED (active matrix organic light emitting diode), SAMOLED (super active matrix light emitting diode), PMOLED (Passive-Matrix light emitting diode).

In another exemplary embodiment, for example, the display device may be configured to be worn on a user's head with sensors, such as biosensors or integrated motion sensors, being incorporated in the control unit for receiving inputs (wirelessly or otherwise) from the user in the form of digital signals representative of information or communications the user wishes to display on the band. Such inputs may, for example, be received from an accelerometer, incorporated in the control unit, or attached to another part of the user's body and connected, wirelessly or otherwise, to the control unit. Alternatively, technologies are emerging whereby such inputs may be conveyed to the device "telepathically". Such a device may be particularly useful in applications for users who are unable to communicate verbally.

Figure 1A:
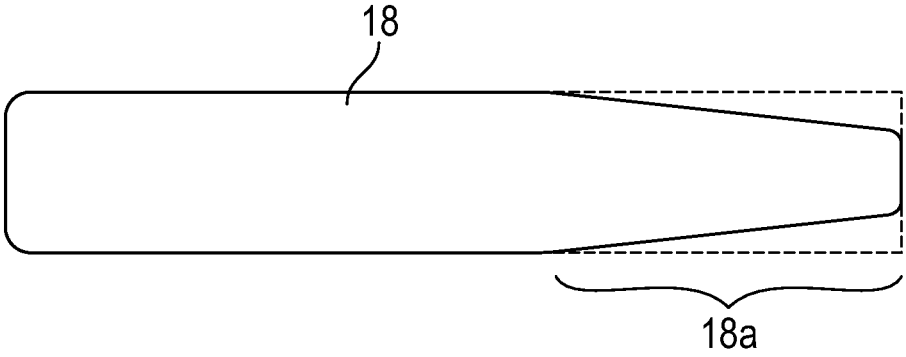
Figure 2:
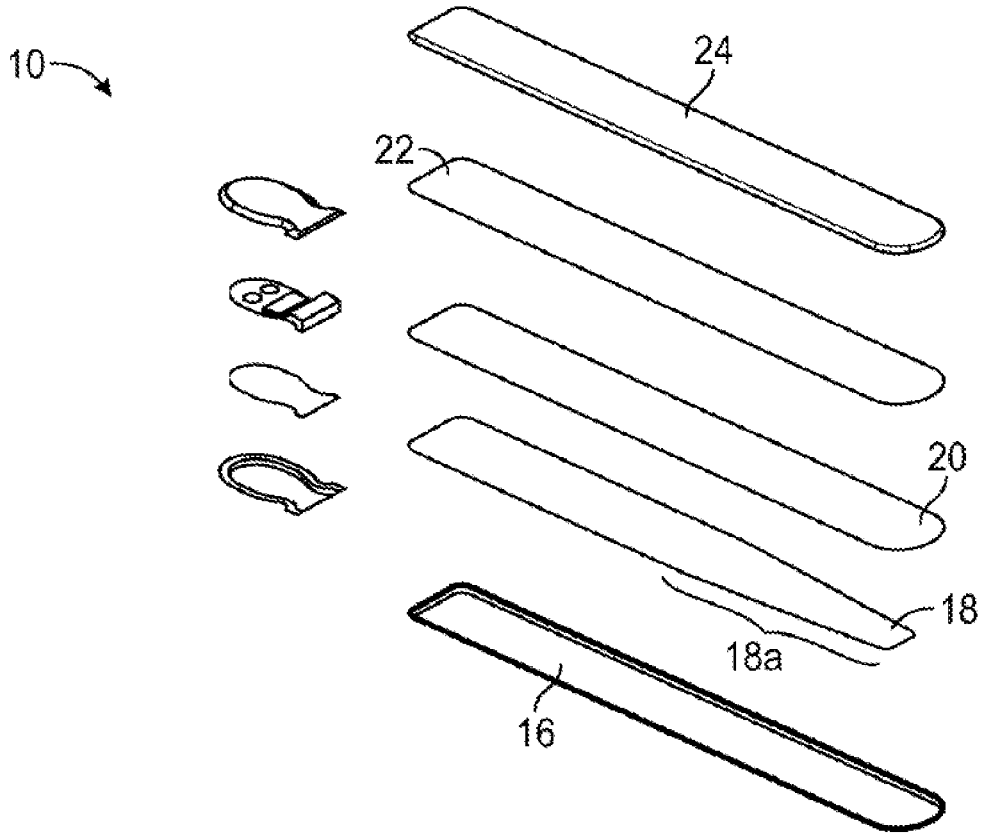
Figure 2A:
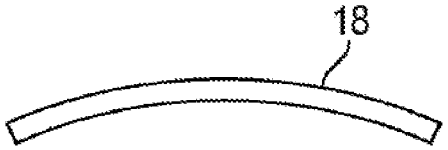
Figure 3:
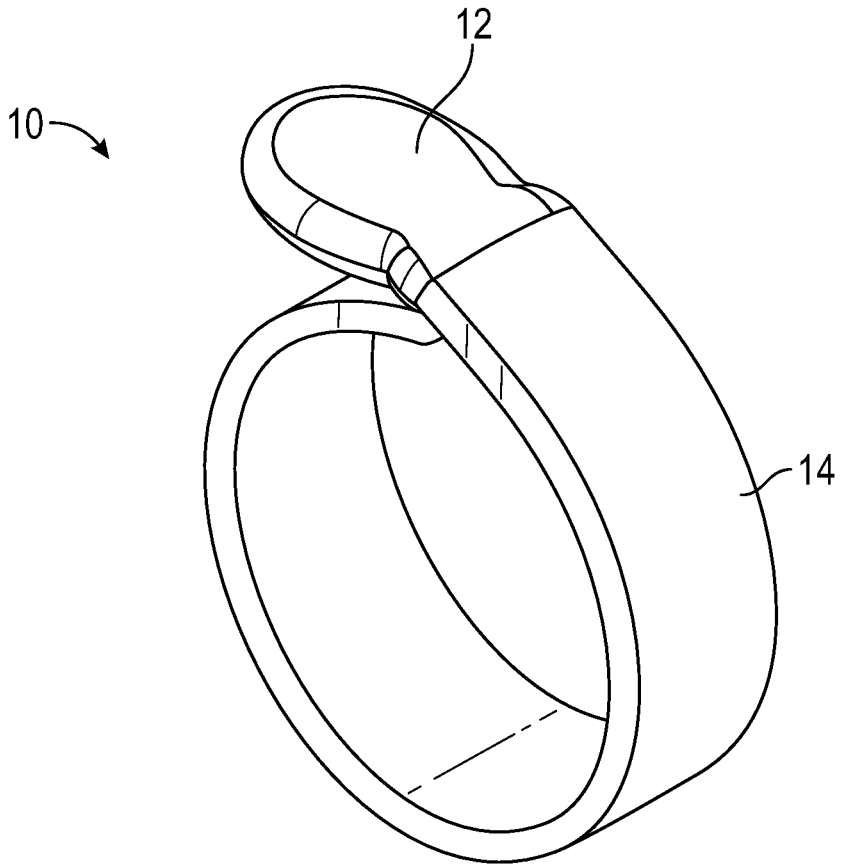

These and other aspects of the invention will be apparent from the following specific description, in which embodiments of the invention are described, by way of examples only, and with reference to the accompanying drawings, in which:

FIG. 1 is a plan view of display apparatus including a wearable band according to an exemplary embodiment of the present invention;

FIG. 1*a* is a schematic plan view of the bistable strip of a wearable band according to an exemplary embodiment of the present invention;

FIG. 2 is a perspective view of the apparatus of FIG. 1 showing the details of the construction of the apparatus;

FIG. 2*a* is a cross-section of part of FIG. 2 to an enlarged scale; and FIG. 3 is a perspective view of the apparatus of FIG. 1 in which the wearable band is in a second, coiled or rolled configuration.

Referring to FIG. 1 of the drawings, there is illustrated a display apparatus, generally referred to as 10, including a wearable band according to an exemplary embodiment of the present invention. The display apparatus 10 comprises two main elements, a control unit 12 and a sprung band 14. The control unit 12 and the sprung band 14 may or may not be permanently connected, and the present invention is not necessarily intended to be in any way limited in this regard.

The sprung band 14 is constructed of several layers which are shown in greater detail in FIG. 2 of the drawings, and which may be held together by, for example, double-sided LSE clear 3M adhesive between adjacent layers.

The bottom layer 16 may, for example, comprise natural rubber or similarly resiliently flexible material for comfort and durability, and may be around 500 μm thick. Above that, there is a bistable layer 18 composed of, for example, plastic coated hardened and tempered steel, which may be around 50 μm thick. The bistable layer 18, which can be additionally seen in FIG. 1*a* of the drawings, is configured to be moveable, under its own tension, from a first state, in which it is substantially axially straight, and a second state in which it is curved or coiled into a ring-like state (as illustrated in FIG. 3 of the drawings).

It will be appreciated that the bistable layer 18 could be formed, additionally or alternatively, of an alternative material to tempered steel. For example, bistable reeled composite (BRC) or graphene could be advantageously utilised. BRC is a structural material formed of high-tech fibres embedded in thermoplastic polymers such that it can take first and second states, namely a long, rigid structure and coiled strip respectively. Such materials may be advantageous compared with tempered steel for a number of reasons. For example, the strip is stable in both states and supports its own weight. Thus, a sliding clip or similar means may be provided to enable the device in its extended or rigid state to be clipped to a user's clothing, for example (in the manner of a pen or the like), without the risk of the device accidently moving to the coiled state. Furthermore, such material may be much more durable than tempered steel in that it can be repeatedly moved between the two states without degradation. Similarly, graphene is exceptionally flexible and durable, whilst being 200 times stronger than steel.

Above the bistable layer 18, there may, in some exemplary embodiments of the invention, be a 100 μm thick electro-luminescent display layer 20 and, above that, a 50 μm polyester deep dyed filter layer 22. Finally, there is an anti-moisture ingress coating 24, which may be around 100 μm thick. All of the above-mentioned layers form a composite sandwich-like structure to make up the sprung band 14.

Referring additionally to FIG. 2*a* of the drawings, the bistable layer 18 has the transverse shape illustrated, that is curved in a gentle arc, when the sprung band 14 is in the above-mentioned first state (i.e. extended and substantially axially straight). When pressure is applied to the ends of the band, and exceeds the yield point of the bistable layer 18, the band 14 moves, under its own tension, into the second, curved state (FIG. 3) and the transverse curve in the bistable layer 18 straightens out. The tension in the bistable layer 18 acts to maintain the band in the curved or "wrapped" state until an opposing force is applied to "peel" it off.

The four layers, excluding the electro-luminescent layer 20, terminate first inside the control unit 12. The electro-luminescent layer 20 continues further into the control unit 12 and adopts its shape. The layer 20 may have a beryllium-copper surface-mounted connector similar to the mounting of an LCD in a mobile phone, for example. This allows the user to have several displays of differing colours and layouts driven from a common driver circuit and battery.

The sprung band 14 may also contain touch sensitive buttons (not shown) to enable a user to control functions of the display apparatus, as required by the application.

It can be seen from FIGS. 1 and 2 of the drawings particularly, that the free end of the sprung band 14, opposite the end at which the control unit 12 is mounted, has tapered side edges along a portion of the length thereof. In the example illustrated, the tapered portion 14*a* of the band 14 comprises about 40% of the total length of the band 14, but this will be dependent on the material used for, and the width and thickness of, the bistable layer 18 and, therefore, its tensile force when in the above-mentioned first (extended) state. It is this tensile force that dictates the speed at which the band 14 springs or otherwise moves from the first state to the second, curved state shown in FIG. 3 of the drawings.

It will be appreciated by a person skilled in the art that, since a principal objective of the tapered portion 14*a* of the band 14 is to slow and soften this movement, the required reduction in tensile force in the bistable layer 18 along this portion will accordingly be dependent on the degree to which the tensile force is to be reduced. It will be appreciated by a person skilled in the art that the side edges of the entire band 14 may be tapered to match the tapered edges of the bistable strip 18, as shown in FIG. 1 of the drawings. However, this is not essential, and in other embodiments (as illustrated in FIG. 2 of the drawings), only the bistable strip 18 has a tapered portion 18*a*, and the strip 18 is embedded or sandwiched within the other layers that are substantially rectangular and not tapered. The present invention is not necessarily intended to be limited in this regard.

Thus, this progressive reduction in tensile force at the end of the band 14 could, for example, be achieved (additionally or alternatively) by a tapering (i.e. progressively reducing) thickness of the bistable layer 18 along the portion 14*a* toward the free end of the band 14. In the example shown, the reduction in tensile force toward the free end of the band 14 is achieved by inwardly tapering side edges, such that the width of the bistable layer 18 (and, indeed, the entire band 14) is progressively reduced along the portion 14*a* toward the free end of the sprung band 14. In the specific example shown, the side edges of the end portion 14*a* of the band 14 taper inwardly (toward the longitudinal axis of the band) at an angle of around 6.5° relative to the axial length of the band 14. However, once again, the specific taper angle will be dependent on the tensile force in the untampered bistable layer 18, the gradual reduction in tensile force required to be achieved, and the length of the portion 14*a*.

Thus, in this specific example, an object of the invention is achieved by using a 50 μm thick tempered steel bistable layer, which may be between 15 and 40 cm in width. An end portion 14, extending over around 30-45% of the total length of the band 14, may be provided having side edges that taper toward the end at an angle of around 5-10° relative to its axial length. However, it will be appreciated by a person skilled in the art that different materials or thickness of materials used to form the bistable layer 18 may require a different relative length of the tapered portion 14*a*, a different angle of tapering or, indeed, additional or alternative tapering of the thickness of the bistable layer 18 toward the free end of the band 14, in order to achieve a desired lessening of the tensile force along the portion 14*a*, and the present invention is not necessarily intended to be limited in this regard.

In use, the band 14 is placed over a user's wrist in its first (extended or flat) state. The user then applies pressure to the ends of the band 14. The sprung band 14 yields to the pressure and moves into the second, coiled state around the user's wrist and, in this form, can be seen most clearly in FIG. 3 of the drawings. The movement from the first to the second state, unlike prior art snap bands, is not a sudden, springing or snapping movement, but a slower, more controlled movement, in view of the tapered side edges, as described above.

The band 14 does not require any latch mechanism, or indeed any other form of retaining means, to hold it in this position, as the tension in the sprung band 14 retains it around the user's wrist until the wearer wishes to remove it.

It will be apparent to a person skilled in the art, from the foregoing description, that modifications and variations can be made to the described embodiments without departing from the scope of the invention as defined by the appended claims.

In particular, as well as variations in the materials used to form the bistable layer 18 and, therefore, the degree to which the tensile force therein needs to be graduated to achieve the desired effect, it will be appreciated that the applications to which the resultant device lends itself, and the functionality that can be incorporated therein, can vary greatly according to requirements. Some configurations of the present invention may include a control unit, as described above, and others may not. The configurations envisaged within the scope of the present invention, and the corresponding technical improvement achieved by the present invention, namely the slowing and softening of the movement of the band between the two states, are particularly advantageous in respect of electronic applications in which any form of electronic component incorporated in the band is protected from degradation and damage that would otherwise be caused by the repeated, often forceful, "snapping of the band between the two states. Where a power supply is required for components within the band, e.g. touch-sensitive control elements, LCD display elements, or even simple LED elements incorporated in the band itself, consideration needs to be given to the manner in which such a power supply will be provided. In the exemplary embodiment described above, a battery is incorporated in a control unit 12 and the electro-luminescent layer defines a connector for carrying power from the battery to the various components incorporated in the layer 20. The layer, 20, is naturally quite fragile and susceptible to damage and the repeated movement thereof between the two band states could, in prior art devices, cause premature failure thereof, whereas the present invention significantly reduces the stress applied to this layer during movement thereof, thus increasing its longevity. In other exemplary embodiments, particularly in the case where a control unit is provided in which all processing/functionality, controls and the device display are provided therein, together with a battery, it may be desirable to provide simple display elements, e.g. LEDs or micro LEDs, in the band itself. Such display elements could be connected to the battery in the control unit via a thin wire or conductive strip extending from the control unit to the elements. Once again, the present invention is highly advantageous in that it minimises the stress to which the conductive wire or strip would otherwise be subjected during state changes, thereby optimising the longevity and reliability of the device. In yet another exemplary embodiment, a flexible battery may be incorporated in the band as one of the layers (in which case, all functionality and controls may be provided within the band itself and the control unit may be omitted in some cases) and, once again, the functionality, structural integrity and life span of such a flexible battery is protected and optimised by the present invention.

For the avoidance of doubt, the present invention may lend itself to a number of different applications, and is not necessarily intended to be limited in this regard. Any level of desired functionality and connectivity can be provided. For example, the device may comprise a music streaming device, including a processor, mobile network connectivity and/or memory, Bluetooth or other connectivity, loudspeaker(s) and/or headphone jack, display elements and controls. All of these components (including the display and control elements) may be provided in a control unit, and the band itself may be entirely passive, or it may include some simple display elements (e.g. LEDs or micro LEDs) as described above. At the other end of the spectrum, all of the functionality, including the display and controls, may be provided as layers of the band, in which case there may be no control unit at all. It is, alternatively envisaged, that the functionality, display and controls of the device may be split between a control unit and the band itself.

More generally, any functionality currently available in computing devices such as smart phones and computer tablets could be incorporated, either wholly or partially within a control unit and/or wearable band. Such functionality may include, but is not limited to, Bluetooth (or other wireless) connectivity, sound sensors and/or loudspeaker(s)/microphone, a micro camera and lens for capturing still or video images, integrated motion sensors, a visual recognition module, Near Field Communications (NFC) capability, biosensors, LTE (e.g. 4G network) connectivity, voice/text communications, etc. Any part of the display and/or controls may be provided in the band itself. Where a control unit is provided, any or all of the functionality, display and controls may be provided therein/thereon. Equally, some exemplary embodiments of the invention may not include a control unit at all, and all functionality, display and controls can be provided in, and supported by, the wearable band. Two-dimensional transistors, flexible PCBs, flexible memory, flexible battery, hybrid electronics (structural/surface/in-mould electronics) and similar technologies may, for example, be utilised in this regard and incorporated in the form of one or more layers within the band. The display may comprise a flexible display on one side, or even both sides, of the wearable band. In any or all cases, the device may incorporate a light sensor to control illumination of the display (whether that is provided on a control unit, on the band itself, or both). The battery, irrespective of the form this may take (if required) may be rechargeable by means of, for example, a conventional charger, conductive charging, or even by means of a solar or thermoelectric cell.

The invention claimed is:

1. An electronic device comprising a power supply and a wearable band of a size and length suitable to be positioned around a limb, or other body part, of a user, said band comprising a flexible bistable strip movable between a first state, in which it is axially straight, and a second, ring-shaped state, and having a yield point, said band being configured such that a radial application of pressure exceeding said yield point to an end of said band causes it to move, under its own tension, from said first state to said second state, wherein a portion of the length of said bistable strip at a free end thereof has a progressively reducing width and/or thickness such that a tensile force in said portion, when said band is in said first state, gradually lessens along said portion toward said free end, the tensile force that gradually lessens being transformed, in use, into a progressively reducing kinetic energy along said portion, toward said free end, that results in a corresponding slowing and softening of movement of the band from said first state to said second state, said wearable band further incorporating a layer located along the length of said bistable strip, said layer having thereon an electronic display comprising one or more light emitting diodes and/or a flexible display screen.

2. The electronic device comprising the wearable band according to claim 1, wherein said portion of the length of the bistable strip has at least one side edge that is tapered toward said end, thereby progressively reducing the width of the bistable strip along the length of said portion.

3. The electronic device comprising the wearable band according to claim 2, wherein both side edges of said portion of the length of the bistable strip are tapered toward said end, thereby progressively reducing the width of the bistable strip along the length of said portion.

4. The electronic device comprising the wearable band according to claim 1, wherein the angle of taper of the or each side edge is between 5° and 20° relative to the axial length of the strip.

5. The electronic device comprising the wearable band according to claim 1, wherein said portion of the length of the strip is at least one sixth of the total length of the strip.

6. The electronic device comprising the wearable band according to claim 1, wherein said portion of the length of the strip is between 30-50% of the total length of the strip.

7. The electronic device comprising the wearable band according to claim 1, wherein the bistable strip comprises an elongate strip of flexible tempered steel, bistable reeled composite or graphene.

8. The electronic device comprising the wearable band according to claim 7, wherein said bistable strip is transversely concave.

9. The electronic device comprising the wearable band according to claim 1, configured to be worn around a user's limb or head.

10. The electronic device comprising the wearable band according to claim 1, further comprising a control unit including a power supply and a conductive strip incorporated in said wearable band connecting said power supply to one or more electronic components on a flexible band incorporated in or on said wearable band.

11. The electronic device comprising the wearable band according to claim 1, wherein the wearable band comprises a rubber backing, a strip of thin steel, bistable reeled composite or graphene forming the bistable strip, an electroluminescent display, a filter layer and an anti-moisture coating.

* * * * *